US006006722A

United States Patent [19]

Hall

[11] Patent Number: 6,006,722

[45] Date of Patent: Dec. 28, 1999

[54] FINE RESOLUTION AIR CONTROL VALVE

[75] Inventor: Brent Alan Hall, Burton, Mich.

[73] Assignee: General Motors Corporation, Detroit, Mich.

[21] Appl. No.: 09/097,120

[22] Filed: Jun. 12, 1998

[51] Int. Cl.[6] ..... F02D 9/08

[52] U.S. Cl. ..... 123/337; 123/403

[58] Field of Search ..... 123/337, 403; 251/305

[56] References Cited

U.S. PATENT DOCUMENTS

| | | | |
|---|---|---|---|
| 4,391,247 | 7/1983 | Shioyama et al. | 123/403 |
| 5,315,975 | 5/1994 | Hattori et al. | 123/337 |
| 5,374,031 | 12/1994 | Semerce et al. | 251/305 |
| 5,465,696 | 11/1995 | Gmelin | 123/337 |
| 5,492,097 | 2/1996 | Byram et al. | 123/396 |
| 5,722,366 | 3/1998 | Adachi et al. | 123/337 |

*Primary Examiner*—Willis R. Wolfe
*Assistant Examiner*—Hieu T. Vo
*Attorney, Agent, or Firm*—Vincent A. Cichosz

[57] ABSTRACT

An air control valve for an engine includes a throttle body defining an air intake passage and a throttle valve rotatably mounted in the passage. The range of valve rotation includes an idle control portion extending from a minimum air flow position to an intermediate air flow position and a power control portion extending from the intermediate air flow position to a maximum air flow position. The intake passage is defined by an internal wall of the throttle body having a pair of arcuate surfaces spaced from the valve periphery, at a maximum first radius from the valve axis, with gradually increasing clearance on opposite sides of the valve axis in the idle control range from the minimum to the intermediate air flow position of the valve. The arcuate surfaces are defined by second and third radii greater than the maximum first radius and centered on second and third axes spaced laterally of the passage a predetermined offset distance beyond the valve axis relative to their respective surfaces. The offset dimensions are chosen to provide fine air flow resolution (gradually increasing air flow) during opening of the throttle valve in the idle control portion of its range with much greater air flow change in the power control portion. The arrangement allows control of the throttle valve with an electronic throttle control actuator with a limited number of control positions.

4 Claims, 2 Drawing Sheets

FINE RESOLUTION AIR CONTROL VALVE

TECHNICAL FIELD

This invention relates to air control valves or throttle bodies for metering air to an internal combustion engine and, particularly, to valves providing fine airflow resolution yielding small percentage changes in air flow in an idle air flow range of throttle valve angular motion.

BACKGROUND OF THE INVENTION

A conventional throttle body includes a bore, a throttle valve, mechanical linkage for actuating the valve, a throttle position sensor and possibly an idle air control actuator responsible for smoothing out the air flow during idle operation. In systems having electronic throttle control, the idle air control function may be performed directly by the electronic throttle control, eliminating the idle air control actuator. To obtain the necessary accuracy in positioning and motion of the valve by an electronic throttle control actuator, the bore of the throttle body or air control valve may be shaped. For example, a spherical shape may be applied to the bore either above or below the valve to block air flow on half the bore for an initial angular rotation of about 10 to 22 degrees. For large bore throttle bodies and normal air flow resolution requirements this is a feasible solution. However, for smaller bores and more precise air flow requirements, a single spherical shape will not produce sufficiently fine air flow resolution (small enough increments of air flow change) to meet idle air flow requirements using a current electronic throttle control actuator. One solution would be to provide a special actuator with finer control steps, at least in the idle range; however, further modification of the throttle body bore could be a more economical solution.

SUMMARY OF THE INVENTION

The present invention provides a modified air control valve having a throttle body bore with arcuate control surfaces on both sides of the throttle valve axis and formed in a novel manner to provide a fine degree of air flow resolution during an initial opening angle of the throttle valve of up to about 45 degrees, or less as desired. The illustrated embodiment shows a circular throttle valve. However the concept may also be applied to throttle body bores having other configurations of throttle valves.

In general, an air control valve according to the invention includes a throttle body having an air intake passage extending therethrough. A throttle valve is rotatably mounted in the passage and is rotatable within a range between a minimum air flow position and a maximum air flow position about a valve axis generally perpendicular to the direction of air flow through the passage. The range of valve rotation includes an idle control portion extending from the minimum air flow position to an intermediate air flow position and a power control portion extending from the intermediate air flow position to the maximum air flow position. The valve has, in longitudinal cross section, a periphery movable in an arc with a maximum first radius centered on the valve axis. The intake passage is defined by an internal wall of the housing having, in longitudinal cross section, a pair of arcuate surfaces spaced from the valve periphery with gradually increasing clearance on opposite sides of the valve axis in the idle control range from the minimum air flow position to the intermediate air flow position of the valve. The arcuate surfaces are defined by second and third radii greater than the maximum first radius and centered on second and third axis spaced laterally of the passage a predetermined offset distance beyond the valve axis relative to their respective surfaces.

The lateral offset of the bore surface axes with their longer radii has been found to allow selection by iterative design steps or otherwise of an offset value that provides a practical degree of fine air flow resolution for control of smaller throttle body bores used in small engines with an available electronic throttle control actuator. If desired, the laterally offset axes of the bore surfaces may be adjusted longitudinally a small amount to accommodate clearances required by shaping of the throttle valve edges. For example, the axes may be moved to alignment with the opposite surfaces of the throttle valve. However, these adjustments may also be accomplished by control of dimensions and tolerances of the throttle body bore and valve as well as its angular positioning and/or edge angle.

These and other features and advantages of the invention will be more fully understood from the following description of certain specific embodiments of the invention taken together with the accompanying drawings.

DESCRIPTION OF THE PREFERRED EMBODIMENT

Figure 1:
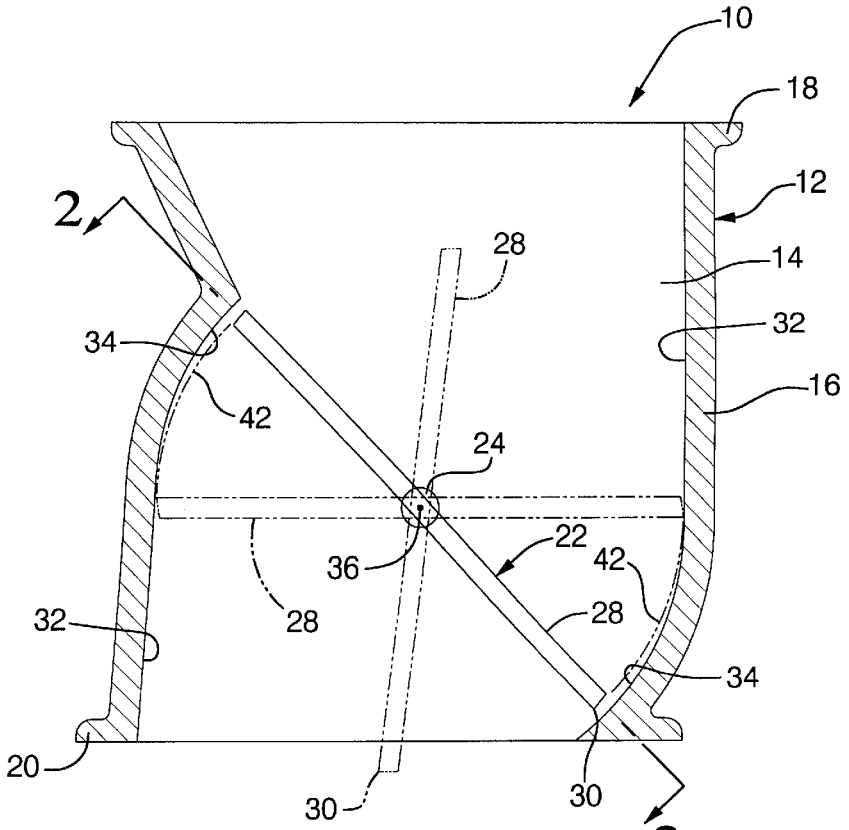
FIG. 1 is a cross-sectional view of an air control valve according to the invention having a throttle valve shown in a partially open position.

Referring now to the drawings in detail, numeral 10 generally indicates an air control valve, or throttle body assembly, for metering air to an internal combustion engine. Assembly 10 includes a throttle body or housing 12 having an air intake passage 14. Passage 14 is defined by a surrounding wall 16 extending between an inlet flange 18 or other connecting means and an outlet flange 20. Housing 12 supports a throttle valve 22 rotatably mounted in the passage.

Valve 22 includes a shaft 24 mounted for rotation in bosses 26 carried in the wall 16. A throttle plate 28 is carried by the shaft and rotatable therewith in the passage 14 to block or control the flow of air therethrough. The throttle plate 28 may be flat with a predetermined thickness at its periphery 30 which is preferably circular. However, it may be of any other desired shape such as elliptical or rectangular as long as the intake passage is shaped to accommodate the configuration of the throttle plate. Optionally, the periphery, or edges, of the throttle plate 28 may be angled slightly to allow air flow control to be concentrated at a leading or trailing edge of the throttle valve periphery 30. In the illustrated embodiment, a two degree relief is formed so that the controlling edge of the throttle plate is the leading edge as the valve is rotated from a closed position, blocking flow through the passage 14, to a fully open position aligned with the direction of air flow in the passage.

Figure 3:
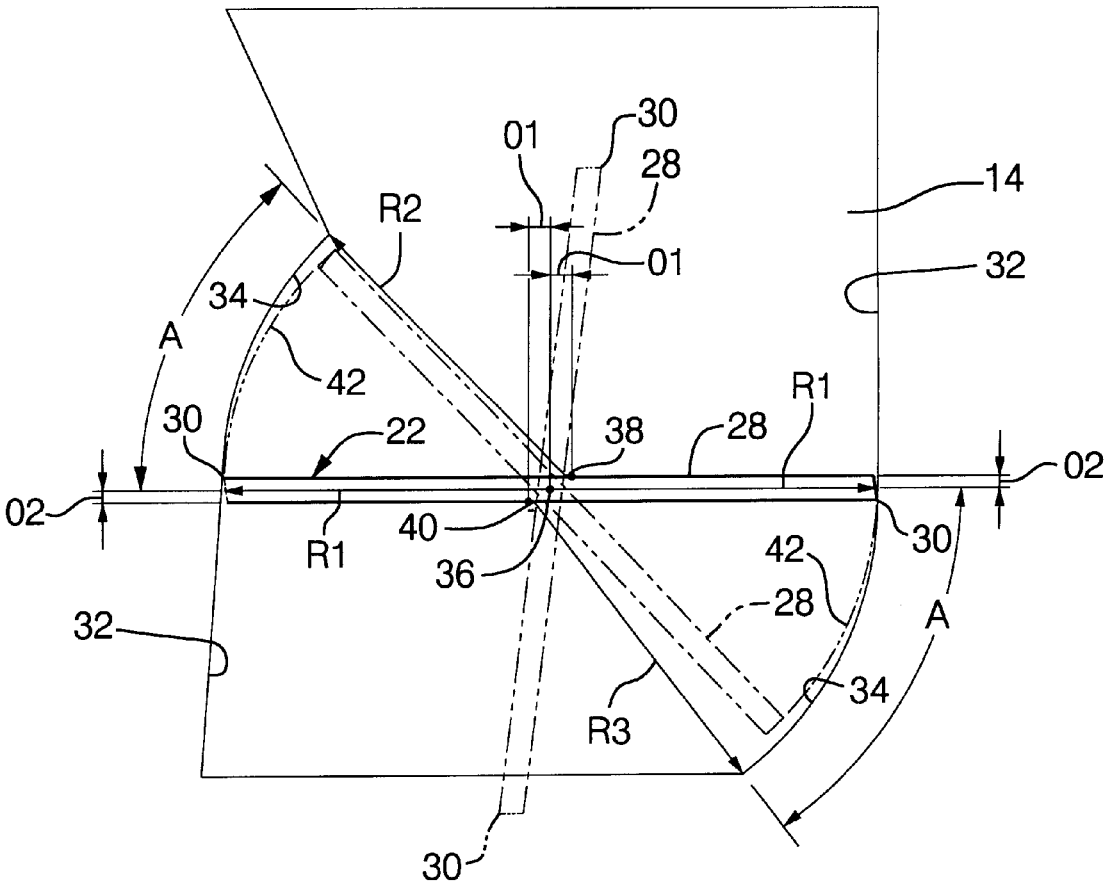
FIG. 3 is a schematic diagram showing the relationship of a throttle valve within a throttle body air passage having shaped surface portions formed by radii from offset axes in an exemplary embodiment of the invention.

Referring now particularly to FIG. 3 there is shown a schematic diagram in which the interior surfaces of the wall 16 are represented by lines 32. The throttle plate 28 is shown in solid lines in the closed position, lying generally perpendicular to the direction of air flow through the intake passage 14. An intermediate position of the throttle is shown in phantom lines wherein the throttle plate is at approximately a 45 degree angle. A fully open position of the throttle is also shown in phantom lines where the throttle plate 28 lies approximately parallel to the direction of air flow through the passage 14.

If the passage 14 were formed as a cylindrical bore, initial rotation of the throttle valve would quickly increase the clearance between the periphery of the throttle valve 28 and the interior surface 32 of the wall, causing a rapid increase in air flow as the throttle valve is opened and producing a relatively course resolution of air flow which is not easily controlled. In order to produce a finer resolution of air flow for idle and low power operation of the engine, the air intake passage 14 is shaped by providing, in the central cross section pictured in FIGS. 1 and 3, a pair of flow controlling arcuate surfaces 34.

Arcuate surfaces 34 are spaced from the valve periphery with gradually increasing clearance on opposite sides of the valve axis as the valve is moved from the closed position shown in solid lines to the intermediate position shown in dashed lines. With these arcuate surfaces providing a gradual increase in clearance, and therefore in air flow, as the valve is opened in a range from 0 to about 45 degrees, a fine resolution of air flow is provided for accurate engine control. Further movement of the throttle valve, somewhat past the 45 degree position in the embodiment shown, moves the valve periphery beyond the arcuate surfaces 34 so that air flow is significantly increased as the valve moves toward a maximum air flow position, shown by dashed lines as the nearly vertical position of the throttle plate 28. Thus, with the arcuate surfaces in place, throttle valve movement from 0 to about 45 degrees open defines a range of motion from a minimum air flow position to an intermediate air flow position, which may be referred to as an idle control portion of throttle movement. Thereafter, movement of the throttle from the intermediate air flow position to the maximum air flow position defines a range of rapid increase in flow which may be defined as a power control portion of throttle valve motion.

In order to provide a desired degree of gradually increasing clearance in the idle control portion of the throttle opening range, the arcuate surfaces 34 are defined by second and third radii R2 and R3 respectively. These radii are greater than the radius R1 of the throttle plate which is centered on the valve axis 36. Radius R2 is centered on a second axis 38 which is parallel to and offset by a predetermined dimension O1 beyond the valve axis 36 relative to its respective surface 34 which the radius R2 defines. In addition, axis 38 is longitudinally offset a dimension O2 which represents half the thickness of the throttle plate 28. Thus, in effect, axis 38 lies along the upper edge of the throttle plate in its closed position which is the leading or controlling edge of the side of the throttle plate which is associated with the arcuate surface 34 defined by radius R2.

In like manner, radius R3 defines an opposite arcuate surface 34 centered on a third axis 40 which is parallel to and offset laterally a dimension O1 beyond the valve axis 36 relative to its respective surface 34. Also axis 40 is offset longitudinally downward a dimension O2 which is half the thickness of the throttle plate 28. Thus, axis 40 lies along the controlling lower surface of the throttle plate when in the closed position illustrated in solid lines in FIG. 3. Lines 42 represent the arcuate paths of the periphery of the throttle plate 28 at its maximum radius R1 during movement of the throttle valve 22 between its closed and intermediate positions.

With these radii R2 and R3 drawn from axes offset laterally, and optionally slightly longitudinally, from the valve axis, a gradual change in clearance is provided during throttle opening between the surfaces 34 and the periphery of the throttle plate at its maximum first radius as indicated by lines 42. This increases the flow of air in a gradual manner as the throttle valve is moved from the closed position, where only minimal if any clearance is provided, to the intermediate position where the clearance between the periphery of the throttle valve and the arcuate surfaces 34 reaches a maximum. The amount of the change in the clearance may be adjusted as desired by varying the lateral offset of the axes on which the arcuate surfaces of the air intake passage are centered. Offsetting longitudinally of these axes is optional and is done only as an aid to avoiding interference of the edges of the throttle plate with the curved surfaces 34 of the housing.

In FIG. 3, the angle A represents an arc through which the arcuate surfaces 34 are extended within the throttle body or housing 12. It is also the approximate angle through which the throttle travels when moving to its intermediate position from the closed position over the range of the idle control portion of the flow passage. This angle may be selected as desired for a particular application to accomplish the idle and possibly low end power control functions of the air control valve 10.

Figure 2:
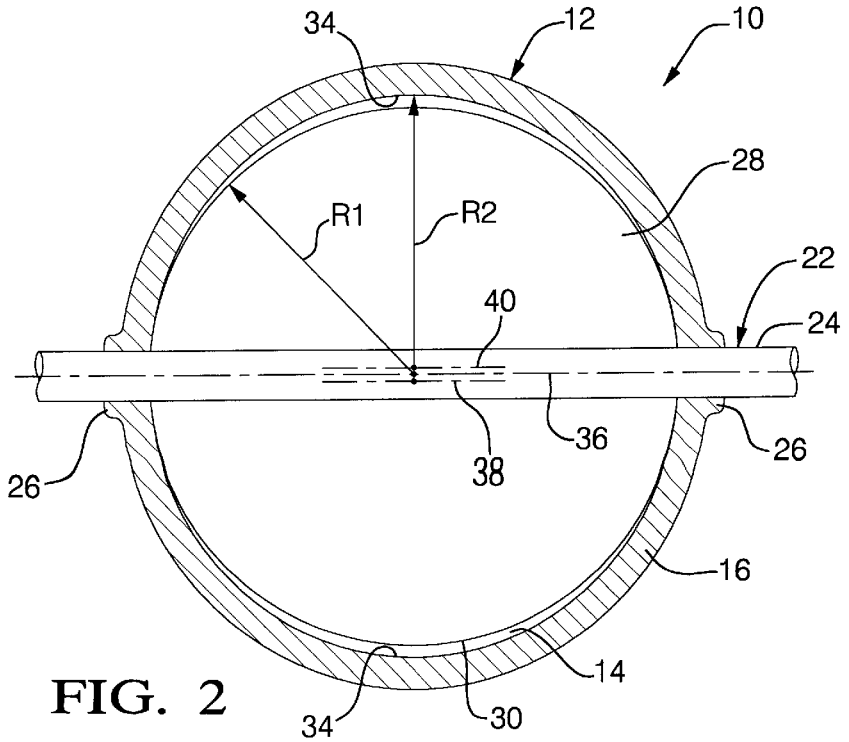
FIG. 2 is a cross-sectional view from line 2—2 of FIG. 1 illustrating the configurations of the throttle valve and bore.

Referring now particularly to FIG. 2, a face view of the throttle plate near its intermediate position, as shown in solid lines in FIG. 1, illustrates the variation in clearance which is preferred in design of the throttle body interior surfaces 34. At the axial center of the throttle plate, as shown by the radius R2 in FIG. 2, the clearance between the periphery 30 of the throttle plate, at radius R1 from axis 36, and the arcuate surface 34, at radius R2 from axis 38, is at a maximum and the periphery 30 lies parallel with the axis 36 of the throttle valve. However, this clearance is reduced proportionally as the angle of the periphery of the throttle plate increases 90 degrees to a position where it lies perpendicular of axis the throttle at the location of the throttle shaft 24. Thus, the clearance gradually decreases from its maximum as shown at radius R2 in FIGS. 2 and 3 to a minimum or essentially zero at the point where the throttle plate joins the throttle shaft 24. This change also occurs on the opposite side of the throttle plate.

Similar proportioning of the clearances may be made with other forms of throttle plates based on the angle of the periphery of the throttle plate relative to the axis 36 of the throttle valve. Accordingly, the clearance at the periphery of the throttle plate in the idle control portion of movement of the throttle varies inversely from a maximum when the throttle plate periphery is parallel to its axis to a minimum or zero when the throttle plate periphery is perpendicular to its axis. While this manner of varying the clearance of the throttle plate is a preferred manner for so doing, it should be apparent that other ways of maintaining or varying the clearance from that at the center point of the throttle may be utilized if desired.

While the invention has been described by reference to certain preferred embodiments, it should be understood that numerous changes could be made within the spirit and scope of the inventive concepts described.

Accordingly it is intended that the invention not be limited to the disclosed embodiments, but that it have the full scope permitted by the language of the following claims.

I claim:

1. An air control valve for metering air to an internal combustion engine and comprising:

a throttle body having an air intake passage extending therethrough;

a throttle valve rotatably mounted in the passage, said valve rotatable within a range between a minimum air flow position and a maximum air flow position about a valve axis generally perpendicular to the direction of air flow through the passage, said range of valve rotation including an idle control portion extending from the minimum air flow position to an intermediate air flow position and a power control portion extending from the intermediate air flow position to the maximum air flow position, said valve having in longitudinal cross section a periphery movable in an arc with a maximum first radius centered on the valve axis;

said intake passage defined by an internal wall of the throttle body having in longitudinal cross section a pair of arcuate surfaces spaced from the valve periphery with gradually increasing clearance on opposite sides of the valve axis in said idle control range from the minimum air flow position to the intermediate air flow position of the valve, said arcuate surfaces defined by second and third radii greater than said maximum first radius and centered on second and third axes spaced laterally of said passage a predetermined offset distance beyond said valve axis relative to their respective surfaces.

2. An air control valve for metering air to an internal combustion engine and comprising:

a throttle body having an air intake passage extending therethrough;

a throttle valve rotatable mounted in the passage, said valve rotatable within a range between a minimum air flow position and a maximum air flow position about a valve axis generally perpendicular to the direction of air flow through the passage, said range of valve rotation including an idle control portion extending from the minimum air flow position to an intermediate air flow position and a power control portion extending from the intermediate air flow position to the maximum air flow position, said valve having in longitudinal cross section a periphery movable in an arc with a maximum first radius centered on the valve axis;

said intake passage defined by an internal wall of the throttle body having in longitudinal cross section a pair of arcuate surfaces spaced from the valve periphery with gradually increasing clearance on opposite sides of the valve axis in said idle control range from the minimum air flow position to the intermediate air flow position of the valve, said arcuate surfaces defined by second and third radii greater than said maximum first radius and centered on second and third axes spaced laterally of said passage a predetermined offset distance beyond said valve axis relative to their respective surfaces;

wherein, in the idle control range of valve motion, the clearance between the internal wall of the throttle body and any portion of the valve periphery in a plane of the valve axis varies from the clearance at said first radius as an inverse function of the angle of the valve periphery relative to the valve axis.

3. An air control valve as in claim 1 wherein said second and third axes are additionally offset longitudinally in said passage.

4. An air control valve for metering air to an internal combustion engine and comprising:

a throttle body having an air intake passage extending therethrough;

a throttle valve rotatable mounted in the passage, said valve rotatable within a range between a minimum air flow position and a maximum air flow position about a valve axis generally perpendicular to the direction of air flow through the passage, said range of valve rotation including an idle control portion extending from the minimum air flow position to an intermediate air flow position and a power control portion extending from the intermediate air flow position to the maximum air flow position, said valve having in longitudinal cross section a periphery moveable in an arc with a maximum first radius centered on the valve axis;

said intake passage defined by an internal wall of the throttle body having in longitudinal cross section a pair of arcuate surfaces spaced from the valve periphery with gradually increasing clearance on opposite sides of the valve axis in said idle control range from the minimum air flow position to the intermediate air flow position of the valve, said arcuate surfaces defined by second and third radii greater than said maximum first radius and centered on second and third axes spaced laterally of said passage a predetermined offset distance beyond said valve axis relative to their respective surfaces;

wherein said second and third axes are additionally offset longitudinally in said passage and the amount of longitudinal offset of the second and third axes is substantially smaller than the amount of lateral offset.

* * * * *